US009932978B2

(12) United States Patent
Engelhardt

(10) Patent No.: US 9,932,978 B2
(45) Date of Patent: Apr. 3, 2018

(54) METHOD FOR CONTROLLING THE OPERATION OF A COMPRESSOR

(75) Inventor: Marek Engelhardt, Friedewald (DE)

(73) Assignee: Continental Teves AG & Co. OHG, Frankfurt (DE)

( * ) Notice: Subject to any disclaimer, the term of this patent is extended or adjusted under 35 U.S.C. 154(b) by 2233 days.

(21) Appl. No.: 12/943,128

(22) Filed: Nov. 10, 2010

(65) Prior Publication Data

US 2011/0052422 A1 Mar. 3, 2011

Related U.S. Application Data

(63) Continuation of application No. PCT/EP2009/054431, filed on Apr. 15, 2009.

(30) Foreign Application Priority Data

Jun. 17, 2008 (DE) ..... 10 2008 028 781

(51) Int. Cl.
*F04B 49/10* (2006.01)
*F04B 49/06* (2006.01)

(52) U.S. Cl.
CPC ..... *F04B 49/065* (2013.01); *F04B 49/10* (2013.01); *F04B 2201/0801* (2013.01)

(58) Field of Classification Search
USPC ..... 417/12, 32, 363, 271, 372
See application file for complete search history.

(56) References Cited

U.S. PATENT DOCUMENTS 3,334,808 A 8/1967 Parker et al.
5,168,415 A 12/1992 Osuga
5,584,675 A * 12/1996 Steurer et al. ..... 417/372
6,212,451 B1 4/2001 Kutscher et al.
6,799,950 B2 10/2004 Meier et al.
2002/0187048 A1* 12/2002 Meier et al. ..... 417/12
(Continued)

FOREIGN PATENT DOCUMENTS

DE 1 503 446 8/1970
DE 1 943 936 3/1971
DE 39 19 407 A1 1/1990
(Continued)

OTHER PUBLICATIONS

International Search Report of PCT/EP2009/054431, dated Jul. 24, 2009.

*Primary Examiner* — Patrick Hamo

(74) *Attorney, Agent, or Firm* — Laurence A. Greenberg; Werner H. Stemer; Ralph E. Locher

(57) ABSTRACT

In a method for controlling the operation of a compressor, the compressor is switched off by a controller in order to prevent thermal damage if an estimated temperature value calculated by the controller exceeds an upper threshold value. The controller calculates a cooling function as a state variable utilizing the estimated temperature value, the cooling function representing the chronological course of the cooling of the compressor. The controller determines the cooling function based on at least one first and one second estimated temperature value which are associated with points of the compressor that are at spatial distances to each other. The calculation of the cooling function is based on a temperature difference between the first and second estimated temperature values.

12 Claims, 1 Drawing Sheet

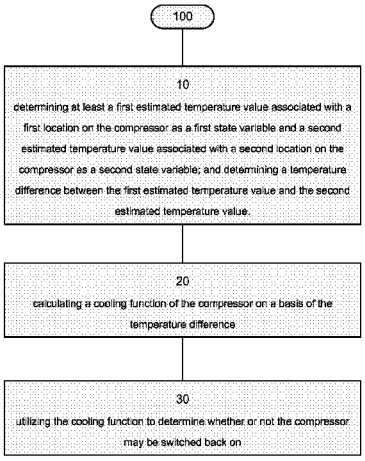

(56) References Cited

U.S. PATENT DOCUMENTS

2007/0098564 A1 5/2007 Sorge

FOREIGN PATENT DOCUMENTS

| | | | |
|---|---|---|---|
| DE | 40 30 475 | A1 | 4/1991 |
| DE | 43 33 591 | A1 | 4/1995 |
| DE | 198 12 234 | A1 | 9/1999 |
| DE | 196 21 946 | C2 | 5/2002 |
| EP | 1 253 321 | A2 | 10/2002 |
| EP | 1 644 640 | A1 | 4/2006 |
| GB | 1 327 055 | | 8/1973 |
| GB | 2 223 331 | A | 4/1990 |

* cited by examiner

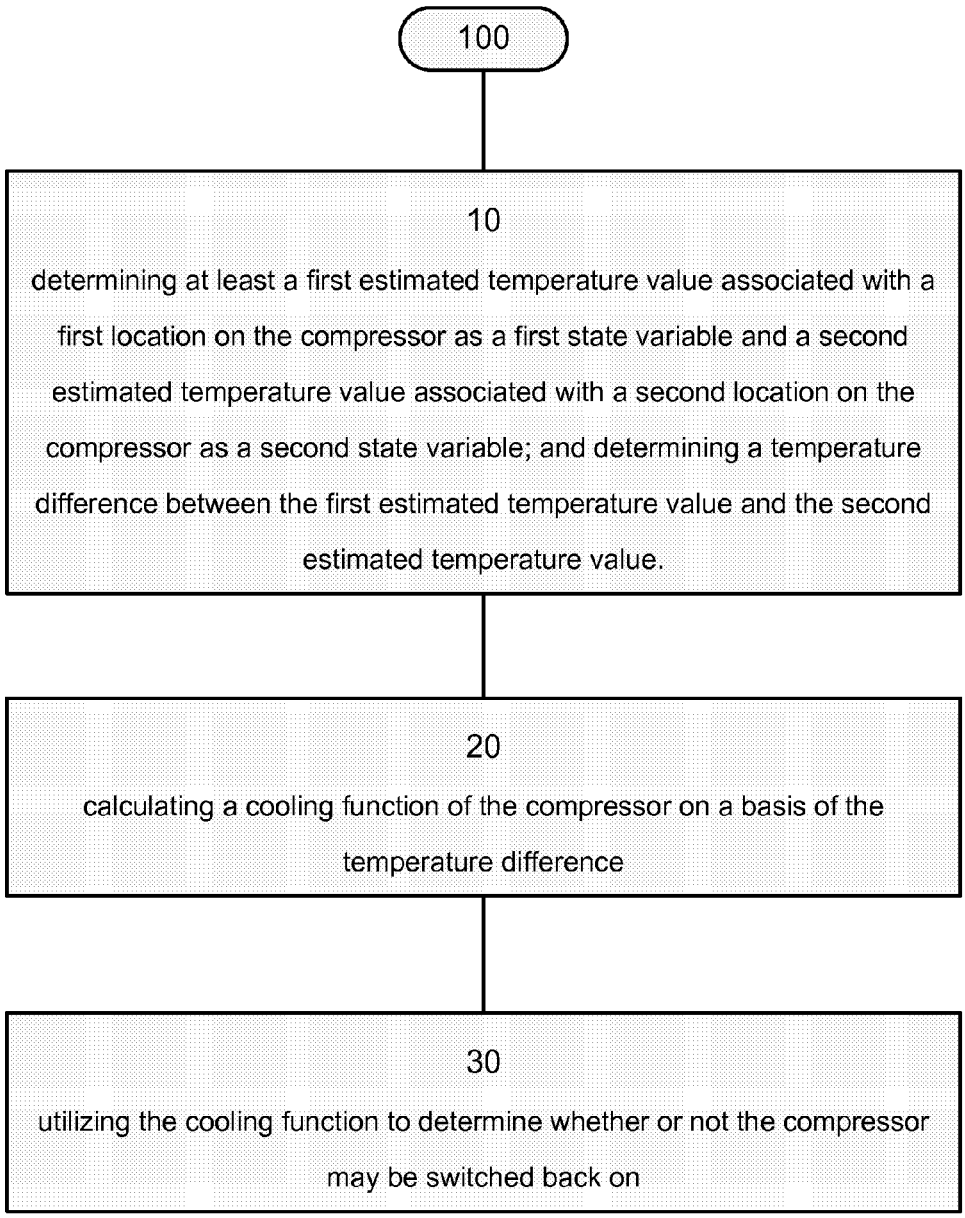
100
10
determining at least a first estimated temperature value associated with a first location on the compressor as a first state variable and a second estimated temperature value associated with a second location on the compressor as a second state variable; and determining a temperature difference between the first estimated temperature value and the second estimated temperature value.
20
calculating a cooling function of the compressor on a basis of the temperature difference
30
utilizing the cooling function to determine whether or not the compressor may be switched back on

METHOD FOR CONTROLLING THE OPERATION OF A COMPRESSOR

CROSS-REFERENCE TO RELATED APPLICATION

This application is a continuation, under 35 U.S.C. § 120, of copending international application PCT/EP2009/054431, filed Apr. 15, 2009, which designated the United States; this application also claims the priority, under 35 U.S.C. § 119, of German patent application No. DE 10 2008 028 781.4, filed Jun. 17, 2008; the prior applications are herewith incorporated by reference in their entirety.

BACKGROUND OF THE INVENTION

Field of the Invention

The invention relates to a method of controlling the operation of a compressor. During the process, the compressor is switched off by a controller in order to avoid thermal damage if an estimated temperature value calculated by the controller exceeds an upper threshold value, and the controller, utilizing the estimated temperature value as a state variable, calculates a cooling function that represents the course over time of the cooling of the compressor after the compressor has been switched off.

In motor vehicles use is frequently made of compressors in which a gaseous or liquid medium can be brought to a pressure which is above the ambient pressure. The gaseous or liquid medium is frequently utilized as a control pressure medium with which, for example, actuators, in particular piston-cylinder arrangements, can be pressurized.

An application in motor vehicles results from the need to supply the air springs of a leveling control system with compressed air in such a manner that the leveling control system is able to move the body of the vehicle to a distance from the road surface that is appropriate to the driving situation. Since such a leveling control system does not adjust the height of the vehicle body constantly, an associated compressor is brought into operation on demand, only when the need arises. The corresponding compressors are generally in the form of electric-motor driven piston compressors. In order to minimize the cost of the compressors, relatively small compressors are increasingly used and, when operating on occasions for relatively long periods, are subjected to considerable thermal stress. The components of the compressors may reach inadmissibly high temperatures. In the event of excessive thermal stress, as a rule the discharge valve or the piston seal of a piston compressor is damaged first, which may eventually lead to failure of the compressor and therefore of the leveling control system.

In order to avoid such damage it is known, as described for example in U.S. Pat. No. 3,334,808 (cf. German published patent application DE 1 503 446 A1) and German published patent application DE 1 943 936 A1, as well as in U.S. Pat. No. 6,799,950 B2 (cf. European published patent application EP 1 253 321 A2), to measure the temperature of the compressor directly in the region of the thermally highly stressed components and, in the event of thermal overload, to switch off the compressor in order to cool it down. A disadvantage of this method is that the necessary temperature sensors are comparatively costly and, in the case of small compressors, are difficult to accommodate because of the confined space in the area concerned. Although the above-mentioned U.S. Pat. No. 6,799,950 B2 and EP 1 253 321 A2 indicate that control of compressor operation may also be effected without temperature sensors on the basis of a thermal model, the content of such a measurement and control method is not further defined.

It is known from German published patent application DE 39 19 407 A1 and U.S. Pat. No. 5,168,415 (cf. DE 40 30 475 A1) to ascertain the thermal load of a compressor via the electric power consumption and/or the operating time of the electric motor associated with the compressor. The concept described in German published patent application DE 43 33 591 A1, to influence the control of a compressor by adding the individual switched-on times and the individual switched-off times thereof, follows a similar direction. The individual switched-on and switched-off times represent one of a number of factors influencing the thermal load of the compressor. It is known from U.S. Pat. No. 6,212,451 (cf. German patent DE 198 12 234 C2) that a compressor may be operated variably with respect to its switched-on and switched-off times. In this case, the actual switched-on duration is to be adapted to the actual operating conditions of the compressor. The heat transfer conditions prevailing between the compressor and the ambient air serve as a parameter according to which the switched-on duration of the compressor is varied. In this case the switched-on duration may be varied, for example as a function of the air temperature and the air flow velocity prevailing in the environment of the compressor, in such a manner that the switched-on duration is shortened when the ambient temperature increases and lengthened when it decreases. In this case the ambient temperature can be determined by mathematical modeling from the actual vehicle external air temperature and/or the vehicle engine intake air temperature. A disadvantage of this known method is that, like all methods based on switched-on duration, it is highly inaccurate because it does not take account of the thermodynamic properties of the compressor itself. For example, the control system has no influence on the temperature range within which the compressor is finally operated.

German patent DE 196 21 946 C2 describes a method for the temperature-based control of a compressor for a pneumatic suspension of a motor vehicle which is in the form of an estimation method and which dispenses with a separate temperature sensor on the compressor. Instead, it is provided that the compressor is switched off by a controller when an estimated temperature value calculated by the controller exceeds an upper threshold value, or the compressor is switched on, or is permitted to be switched on, when a lower threshold value is not reached. For this purpose, the last estimated temperature value upon switching on the compressor is increased by a given temperature jump, the degree of which depends on the amount of the last estimated value. Furthermore, the estimated value is increased in a predefined manner during an operation of the compressor, and is decreased in a predefined manner when the compressor is stationary. A disadvantage of this method is, since the linear correlations underlying the method generally are not present in practice, since the temperature changes with large temperature differences are greater than with small temperature differences. Moreover, in reality the temperature jump does not take place instantaneously, so that the availability of the compressor for control procedures is also disadvantageously reduced in this range.

A method of the type in question for controlling the operation of the compressor is described in commonly assigned U.S. patent application publication No. US 2007/0098564 A1 and its European counterpart patent EP 1 644 640 B1; there, the compressor is switched off by a controller in order to avoid thermal damage if an estimated temperature value calculated by the controller exceeds an upper threshold value. In that prior art method the controller, utilizing the estimated temperature value as a state variable, calculates a cooling function which represents the course over time of the cooling of the compressor.

SUMMARY OF THE INVENTION

It is accordingly an object of the invention to provide a method of controlling the operation of a compressor which overcome the above-mentioned disadvantages of the heretofore-known devices and methods of this general type and which provides for a novel process that allows the cooling function to be determined more precisely.

With the foregoing and other objects in view there is provided, in accordance with the invention, a method of controlling an operation of a compressor, the method to be executed by a controller connected to the compressor, the method which comprises:

calculating an estimated temperature value and, if the estimated temperature value calculated by the controller exceeds an upper threshold value, switching the compressor off in order to avoid thermal damage;

determining at least a first estimated temperature value associated with a first location on the compressor as a first state variable and a second estimated temperature value associated with a second location on the compressor as a second state variable, the second location being disposed at a spacing distance from the first location, and determining a temperature difference between the first estimated temperature value and the second estimated temperature value; and calculating a cooling function of the compressor on a basis of the temperature difference, the cooling function representing a course over time of a cooling of the compressor after the compressor has been switched off, and utilizing the cooling function to determine whether or not the compressor may be switched back on.

The invention is based on the recognition of the fact that, in a case in which the compressor has been operated in such a manner that it has heated up strongly only in a region of the discharge valve, for example, but otherwise has not heated up completely or extensively throughout, the cooling function follows a different course than in a case in which the compressor has been operated in such a manner that it has heated up strongly, for example, not only in the region of the discharge valve but completely or extensively throughout.

Starting from this consideration, the invention is based on the concept of determining the cooling function on the basis of a temperature gradient between the temperatures at two or more points on the compressor which are at a spatial distance from one another. Accordingly, the controller determines the cooling function on the basis of at least a first and a second estimated temperature value which are associated with points on the compressor at a spatial distance from one another, in such a manner that the cooling function is determined on the basis of a temperature difference between the first estimated temperature value and the second estimated temperature value. In this way, the cooling function can be determined substantially more accurately.

If, for example, the compressor has been operated in such a manner that it has heated up predominantly at a point associated with the first estimated temperature value, for example in the region of its discharge valve, while it has heated up less strongly at a point associated with the second estimated temperature value corresponding, for example, to an outer surface of the compressor housing, the temperature gradient between the points on the compressor which are considered is relatively steep. Accordingly, after being switched off the compressor will cool down relatively rapidly through heat dissipation to the environment, so that the controller calculates a cooling function which corresponds to such relatively rapid cooling. If, on the other hand, the compressor has been operated in such a manner that it has heated up relatively strongly both at a point associated with the first estimated temperature value and at a point associated with the second estimated temperature value, the temperature gradient between the points on the compressor which are considered is less steep. In such a case the compressor will cool down relatively slowly through heat dissipation to the environment. Accordingly, the controller calculates a cooling function which corresponds to slower cooling of the compressor.

Since the cooling function can be determined more precisely by way of the novel method, the reaction speed of the control system of the operation of the compressor is increased, in accordance with the invention. In particular it is possible to switch the compressor back on relatively quickly if the cooling function determined corresponds to relatively rapid cooling. The reaction possibilities of the control system during operation of the compressor are thereby extended. For example, it is possible to put the compressor back into operation immediately after relatively rapid cooling if, for example, a leveling control system of a motor vehicle requires lowering of the vehicle body in order to protect pedestrians.

In this way the operating safety of a motor vehicle equipped with such a leveling control system is substantially increased.

The basic process of determining the cooling function is known to the those of skill in the pertinent art, as described in the above-mentioned publication US 2007/0098564 A1 and in European patent EP 1 644 640 B1. The entire content of US 2007/0098564 A1 and EP 1 644 640 B1 is herewith incorporated by reference.

The points on the compressor associated spatially with the first and second estimated temperature values are selectable within wide limits, according to the particular requirements, constructional factors and operating states of the compressor. Starting from the consideration that cooling of the compressor takes place primarily through heat dissipation to the environment, an advantageous development of the teaching according to the invention provides that a point on the compressor spatially associated with the second estimated temperature value is located closer to a region which is at ambient temperature than a point associated spatially with the first estimated temperature value. In this way, precision in determining the cooling function is further increased. In this case the points associated with the estimated temperature values are selected, for example and especially, in such a manner that a steep temperature gradient is produced between these points during a predominantly local heating up of the compressor, for example in the region of the discharge valve.

This temperature gradient is especially steep if the first estimated temperature value is associated with a point on the compressor at which the compressor heats up relatively quickly in operation, and/or if the second estimated temperature value is associated with a point on the compressor at which the compressor heats up relatively slowly in operation, as is provided by advantageous developments of the teaching according to the invention.

Since the compressor is known from experience to heat up most rapidly in the region of its discharge valve or its piston seal, and relatively slowly on an outer surface of its housing, advantageous developments of the invention provide that the first point is arranged in the region of a discharge valve or a piston seal of the compressor, and/or that the second point is arranged in the region of an outer surface of the housing of the compressor, especially in the region of its cylinder head.

The controller can determine the cooling function while taking account of any desired number of further state variables. Thus, an advantageous development of the invention provides that the controller determines the cooling function while taking account of further state variables, in particular the ambient temperature and/or the compressor voltage and/or an admission pressure and a back pressure of the compressor. Another advantageous development of the invention provides that, after the controller has been switched on and switched on again, the controller determines while taking account of, the cooling function determined and that between the switching on and switching on again of the controller, the time at which the temperature has fallen below a lower threshold value and at which the compressor can be switched on again.

Other features which are considered as characteristic for the invention are set forth in the appended claims.

Although the invention is described herein as embodied in a method for controlling the operation of a compressor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific implementations and embodiments.

BRIEF DESCRIPTION OF THE DRAWING

The soul drawing FIGURE is a block diagram illustrating steps of the method

DETAILED DESCRIPTION OF THE INVENTION

In a method according to the invention for controlling the operation of a compressor, the compressor is first subjected in a test bed assembly to various operating states, in particular with respect to the duration of its operation, to the ambient temperature, to the compressor voltage and to the admission pressure and back pressure of the compressor. In these tests the course over time of the temperature of the compressor at a first point, which in this exemplary embodiment is arranged in the region of a discharge valve of the compressor, is measured by means of a first temperature sensor and stored, in particular during cooling of the compressor in the switched-off state. In addition, the course over time of the temperature of the compressor is measured by means of a second temperature sensor at a second point, which in this exemplary embodiment is arranged in the region of the cylinder head of the compressor. The temperature curves obtained in this way for various operating states are stored and fed into a software of the controller of the compressor, so that, in the installed state of the compressor, for example on a leveling control system of a motor vehicle, estimated temperature values can be determined by the controller. No temperature sensor, or its operation, is required in the installed state of the compressor.

In the installed state, the compressor is controlled by the controller in such a manner that, in order to avoid thermal damage, the controller switches off the compressor if an estimated temperature value calculated by the controller exceeds an upper threshold value.

During operation of the compressor, the controller, with the aid of its software, calculates continuously over time or at intervals a first estimated temperature value, which in the exemplary embodiment is associated with a point in the region of the discharge valve of the compressor, and a second estimated temperature value, which in the exemplary embodiment is associated with a point in the region of the cylinder head of the compressor. On the basis of these estimated temperature values, the controller additionally calculates a cooling function which represents the course over time of the cooling of the compressor after it has been switched off. In this case, the controller determines the cooling function, according to the invention, on the basis of the first and the second estimated temperature values, in such a manner that the cooling function is determined on the basis of the temperature difference between the first estimated temperature value and the second estimated temperature value.

If the first estimated temperature value exceeds an upper threshold value, the controller switches off the compressor in order to avoid thermal damage. If the controller remains switched on after the compressor has been switched off, it calculates, on the basis of the estimated temperature values, the cooling function from which it can be inferred at what time the compressor can be switched on again without giving rise to thermal damage in the compressor. If the temperature difference between the first and the second estimated temperature values is relatively large, this means that the compressor has heated up relatively strongly locally, above all at its discharge valve, without being heated relatively strongly throughout. This yields a cooling function corresponding to more rapid cooling, so that the temperature falls relatively quickly below a lower threshold value and, accordingly, the compressor can be switched on again relatively quickly.

If, on the other hand, the controller ascertains that the temperature difference between the first and second estimated temperature values is relatively small, it follows that the compressor has heated up relatively strongly not only in the region of its discharge valve, but has heated up relatively strongly throughout.

This yields a cooling function corresponding to relatively slow cooling, so that the temperature falls below the lower threshold value, at which the compressor can be switched back on, only after a relatively long time.

If the controller is switched off when, or shortly after, the compressor is switched off, for example when the ignition of the motor vehicle is switched off, the cooling function is calculated, on the basis of the estimated temperature values determined for the time of switching off, as soon as the controller is switched on again—that is, for example, when the ignition of the motor vehicle is switched on. On the basis of the cooling function determined and the time which has elapsed between switching off the compressor and switching on the controller again, the controller can then ascertain the time at which the temperature of the compressor has fallen below a lower threshold value, and at which the compressor can therefore be switched on again.

On the basis of the teaching according to the invention, the cooling function can be determined more precisely, since it is determined, according to the invention, not on the basis of a single estimated temperature value but on the basis of a temperature difference between two estimated temperature values.

The advantages of the teaching according to the invention are already obtained if only the difference between two temperature values is determined. However, it is also possible according to the invention to determine the cooling function on the basis of at least two temperature differences from at least three estimated temperature values. According to the particular requirements, a use of two or more temperature differences makes possible still more accurate information on the spatial distribution of heat in the compressor.

The sole FIGURE is a block diagram illustrating the major steps of the method 100. These steps are performed with a controller. Step 10 includes determining at least a first estimated temperature value associated with a first location on the compressor as a first state variable and a second estimated temperature value associated with a second location on the compressor as a second state variable. The second location is disposed at a spacing distance from the first location. Step 10 also includes determining a temperature difference between the first estimated temperature value and the second estimated temperature value. Step 20 includes calculating a cooling function of the compressor on a basis of the temperature difference. The cooling function represents a course over time of a cooling of the compressor after the compressor has been switched off. Step 30 includes utilizing the cooling function to determine whether or not the compressor may be switched back on.

The invention claimed is:

1. A method of controlling an operation of a compressor, the method to be executed by a controller connected to the compressor, the method which comprises:

with the controller, determining at least a first estimated temperature value associated with a first location on the compressor as a first state variable and a second estimated temperature value associated with a second location on the compressor as a second state variable, the second location being disposed at a spacing distance from the first location, and determining a temperature difference between the first estimated temperature value and the second estimated temperature value;

with the controller, calculating a cooling function of the compressor on a basis of the temperature difference, the cooling function representing a course over time of a cooling of the compressor after the compressor has been switched off; and with the controller, utilizing the cooling function to determine whether or not the compressor may be switched back on.

2. The method according to claim 1, wherein the second location on the compressor that is spatially associated with the second estimated temperature value is located closer to a region that is at ambient temperature than the first location spatially associated with the first estimated temperature value.

3. The method according to claim 1, wherein the first estimated temperature value is associated with a location on the compressor at which the compressor heats up relatively quickly in operation.

4. The method according to claim 3, wherein the second estimated temperature value is associated with a location on the compressor at which the compressor heats up relatively slowly in operation.

5. The method according to claim 1, wherein the second estimated temperature value is associated with a location on the compressor at which the compressor heats up relatively slowly in operation.

6. The method according to claim 1, wherein the first estimated temperature value is associated with a location that is arranged in a region of a discharge valve or a piston seal of the compressor.

7. The method according to claim 1, wherein the second estimated temperature value is associated with a location at an outer surface of a housing of the compressor.

8. The method according to claim 7, wherein the second estimated temperature value is associated with a location on a cylinder head of the compressor.

9. The method according to claim 1, which comprises determining the cooling function with the controller while taking account further state variables.

10. The method according to claim 9, which comprises selecting the further state variables from the group consisting of an ambient temperature and/or a compressor voltage and/or an admission pressure and/or back pressure of the compressor.

11. A method of controlling an operation of a compressor, the method to be executed by a controller connected to the compressor, the method which comprises:

with the controller, determining at least a first estimated temperature value associated with a first location on the compressor as a first state variable and a second estimated temperature value associated with a second location on the compressor as a second state variable, the second location being disposed at a spacing distance from the first location, and determining a temperature difference between the first estimated temperature value and the second estimated temperature value;

with the controller, calculating a cooling function of the compressor on a basis of the temperature difference, the cooling function representing a course over time of a cooling of the compressor after the compressor has been switched off, and utilizing the cooling function to determine whether or not the compressor may be switched back on; and after the controller had been switched off and then switched back on, determining with the controller, while taking account of the cooling function and a time elapsed between the switching off and the switching on of the controller, a time at which the temperature has fallen below a lower threshold value and at which the compressor can be switched back on.

12. A method of controlling an operation of a compressor, the method to be executed by a controller connected to the compressor, the method which comprises:

with the controller, determining at least a first estimated temperature value associated with a first location on the compressor as a first state variable and a second estimated temperature value associated with a second location on the compressor as a second state variable, the second location being disposed at a spacing distance from the first location, and determining a temperature difference between the first estimated temperature value and the second estimated temperature value;

with the controller, calculating a cooling function of the compressor on a basis of the temperature difference, the cooling function representing a course over time of a cooling of the compressor after the compressor has been switched off, and utilizing the cooling function to determine whether or not the compressor may be switched back on; and after the controller had been switched off and then switched back on, determining the cooling function based on the estimated temperature values at the time when the controller was switched off, and taking into account a time elapsed between the switching off and the switching back on of the controller.

* * * * *